US009761935B2

(12) United States Patent
Ross, III et al.

(10) Patent No.: US 9,761,935 B2
(45) Date of Patent: Sep. 12, 2017

(54) HDTV ANTENNA ASSEMBLIES

(71) Applicant: Antennas Direct, Inc., Ellisville, MO (US)

(72) Inventors: John Edwin Ross, III, Moab, UT (US); Richard E. Schneider, Wildwood, MO (US)

( * ) Notice: Subject to any disclaimer, the term of this patent is extended or adjusted under 35 U.S.C. 154(b) by 7 days.

(21) Appl. No.: 14/878,504

(22) Filed: Oct. 8, 2015

(65) Prior Publication Data

US 2017/0062919 A1 Mar. 2, 2017

Related U.S. Application Data

(60) Provisional application No. 62/213,437, filed on Sep. 2, 2015.

(51) Int. Cl.

| | |
|---|---|
| ***H01Q 7/00*** | (2006.01) |
| ***H01Q 1/38*** | (2006.01) |
| ***H01Q 5/20*** | (2015.01) |
| ***H01Q 1/50*** | (2006.01) |

(52) U.S. Cl.
CPC ..... *H01Q 1/38* (2013.01); *H01Q 1/50* (2013.01); *H01Q 5/20* (2015.01); *H01Q 7/00* (2013.01)

(58) Field of Classification Search
CPC .. H01Q 1/36; H01Q 7/00; H01Q 1/50; H01Q 9/285
See application file for complete search history.

(56) References Cited

U.S. PATENT DOCUMENTS

| | | | |
|---|---|---|---|
| 2,060,098 | A | 11/1936 | Norman |
| 2,220,008 | A | 10/1940 | Woodward et al. |
| 2,437,251 | A | 3/1948 | Frische et al. |
| 2,480,155 | A | 8/1949 | Masters |

(Continued)

FOREIGN PATENT DOCUMENTS

| | | |
|---|---|---|
| CN | ZL2008200072832 | 5/2009 |
| CN | ZL2008301199963 | 5/2009 |

(Continued)

OTHER PUBLICATIONS

IEEE Spectrum: Antennas for the New Airwaves, http://www.spectrum.ieee.org/print/7328, Published Feb. 2009, 9 pages, Authors Richard Schneider and John Ross.

(Continued)

*Primary Examiner* — Dieu H Duong
(74) *Attorney, Agent, or Firm* — Harness, Dickey & Pierce, P.L.C.

(57) ABSTRACT

Exemplary embodiments are disclosed of HDTV antenna assemblies. In an exemplary embodiment, a high definition television antenna assembly generally includes an antenna element having a generally annular shape with an opening and first and second end portions. First and second arms are spaced apart from the antenna element and extend at least partially along portions of the antenna element. A first member extends between the first arm and the first end portion of the antenna element. A second member extends between the second arm and the second end portion of the antenna element. A substrate supports and/or is coupled to the antenna element, the first and second arms, and the first and second members.

24 Claims, 13 Drawing Sheets

(56) References Cited

U.S. PATENT DOCUMENTS

| | | | | |
|---|---|---|---|---|
| 2,551,664 | A * | 5/1951 | Galper | H01Q 9/265 156/250 |
| 2,589,578 | A | 3/1952 | Sabins | |
| D170,203 | S | 8/1953 | Leonard | |
| D171,560 | S | 2/1954 | Ritter | |
| D177,200 | S | 3/1956 | Valiulis | |
| D179,111 | S | 11/1956 | Ballan | |
| 2,821,710 | A | 1/1958 | Hale | |
| 3,015,101 | A | 12/1961 | Turner et al. | |
| 3,123,826 | A | 3/1964 | Durham | |
| 3,161,975 | A | 12/1964 | McMillan | |
| 3,239,838 | A | 3/1966 | Kelleher | |
| 3,261,019 | A | 7/1966 | Lundy | |
| 3,273,158 | A | 9/1966 | Fouts et al. | |
| D209,402 | S | 11/1967 | Burlingame | |
| D211,025 | S | 5/1968 | Callaghan | |
| 3,434,145 | A | 3/1969 | Wells | |
| 3,560,983 | A | 2/1971 | Willie et al. | |
| 3,587,105 | A | 6/1971 | Neilson | |
| 3,721,990 | A | 3/1973 | Gibson et al. | |
| 3,828,867 | A | 8/1974 | Elwood | |
| 3,971,031 | A | 7/1976 | Burke | |
| 4,183,027 | A | 1/1980 | Ehrenspeck | |
| 4,184,163 | A | 1/1980 | Woodward | |
| 4,418,427 | A | 11/1983 | Muterspaugh | |
| D310,671 | S | 9/1990 | Weiss | |
| 4,987,424 | A | 1/1991 | Tamura et al. | |
| D318,673 | S | 7/1991 | Terk | |
| D327,690 | S | 7/1992 | Ogawa et al. | |
| D332,262 | S | 1/1993 | Borchardt | |
| 5,280,645 | A | 1/1994 | Nguyen et al. | |
| D344,731 | S | 3/1994 | Witzky | |
| 5,313,218 | A | 5/1994 | Busking | |
| 5,943,025 | A | 8/1999 | Benham et al. | |
| D414,495 | S | 9/1999 | Heiligenstein et al. | |
| D421,610 | S | 3/2000 | Ghalebi | |
| 6,054,963 | A | 4/2000 | Muterspaugh | |
| 6,239,764 | B1 | 5/2001 | Timofeev et al. | |
| D449,593 | S | 10/2001 | Schultz | |
| 6,590,541 | B1 | 7/2003 | Schultze | |
| 6,593,886 | B2 | 7/2003 | Schantz | |
| D480,714 | S | 10/2003 | Wang | |
| 6,680,708 | B2 | 1/2004 | Yamaki | |
| D501,468 | S | 2/2005 | Wang | |
| 6,885,352 | B2 | 4/2005 | Lee et al. | |
| 6,917,793 | B2 | 7/2005 | Wang | |
| 7,091,925 | B1 | 8/2006 | Wang | |
| 7,126,556 | B1 | 10/2006 | Wang | |
| 7,209,089 | B2 | 4/2007 | Schantz | |
| D544,471 | S | 6/2007 | Wang | |
| 7,239,290 | B2 | 7/2007 | Poilasne et al. | |
| 7,245,266 | B1 | 7/2007 | Szente et al. | |
| D558,189 | S | 12/2007 | Inoue | |
| D581,931 | S | 12/2008 | Pine | |
| D585,883 | S | 2/2009 | Kaneko | |
| D598,433 | S | 8/2009 | Schneider et al. | |
| D598,434 | S | 8/2009 | Schneider et al. | |
| 7,609,222 | B2 | 10/2009 | Schneider et al. | |
| D604,276 | S | 11/2009 | Schneider et al. | |
| D611,460 | S | 3/2010 | Chao | |
| 7,693,570 | B2 | 4/2010 | Green et al. | |
| D624,531 | S | 9/2010 | Fleck et al. | |
| 7,839,347 | B2 | 11/2010 | Schneider et al. | |
| 7,839,351 | B2 | 11/2010 | Schadler et al. | |
| 7,898,496 | B2 | 3/2011 | Olsen et al. | |
| 7,936,311 | B2 | 5/2011 | Rowser et al. | |
| 7,990,335 | B2 | 8/2011 | Schneider et al. | |
| D666,178 | S | 8/2012 | Schneider et al. | |
| 8,368,607 | B2 | 2/2013 | Schneider et al. | |
| 2002/0158798 | A1 | 10/2002 | Chiang et al. | |
| 2003/0071757 | A1 | 4/2003 | Yamaki | |
| 2004/0090379 | A1 | 5/2004 | Fourdeux et al. | |
| 2004/0090385 | A1 | 5/2004 | Green | |
| 2004/0113841 | A1 | 6/2004 | Louzir et al. | |
| 2004/0217912 | A1 | 11/2004 | Mohammadian | |
| 2005/0088342 | A1 | 4/2005 | Parsche | |
| 2005/0162332 | A1 | 7/2005 | Schantz | |
| 2005/0259023 | A1 | 11/2005 | Wang | |
| 2005/0280582 | A1 | 12/2005 | Powell et al. | |
| 2006/0033665 | A1 | 2/2006 | Yang | |
| 2006/0055618 | A1 | 3/2006 | Poilasne et al. | |
| 2006/0077115 | A1 | 4/2006 | Oh et al. | |
| 2006/0103577 | A1 | 5/2006 | Lee | |
| 2006/0164304 | A1 | 7/2006 | Huang et al. | |
| 2007/0069955 | A1 | 3/2007 | McCorkle | |
| 2007/0200769 | A1 | 8/2007 | Nakano et al. | |
| 2008/0094291 | A1 | 4/2008 | Bystrom et al. | |
| 2008/0211720 | A1 | 9/2008 | Hansen | |
| 2008/0258980 | A1 | 10/2008 | Chen et al. | |
| 2008/0291345 | A1 | 11/2008 | Schneider | |
| 2009/0058732 | A1 | 3/2009 | Nakano et al. | |
| 2009/0073067 | A1 | 3/2009 | Soler Castany et al. | |
| 2009/0146899 | A1 | 6/2009 | Schneider et al. | |
| 2010/0085269 | A1 | 4/2010 | Sadowski et al. | |
| 2012/0169553 | A1* | 7/2012 | Nomura | H01Q 1/38 343/741 |
| 2012/0249396 | A1* | 10/2012 | Parsche | H01Q 1/243 343/866 |
| 2014/0292597 | A1 | 10/2014 | Schneider et al. | |

FOREIGN PATENT DOCUMENTS

| | | |
|---|---|---|
| CN | 101453057 A | 6/2009 |
| CN | ZL2008301199978 | 7/2009 |
| CN | ZL2008300091398 | 9/2009 |
| EM | 000946587 | 5/2008 |
| EP | 1555717 | 7/2005 |
| EP | 1653560 | 5/2006 |
| EP | 1753080 | 2/2007 |
| GB | 2263360 | 7/1993 |
| JP | D1213590 | 6/2004 |
| TW | M249233 | 11/2004 |
| TW | D112283 | 8/2006 |
| TW | D119092 | 9/2007 |
| TW | 200926506 | 6/2009 |
| TW | D129744 | 7/2009 |
| TW | D129745 | 7/2009 |
| TW | D129746 | 7/2009 |
| WO | WO2009073249 | 6/2009 |

OTHER PUBLICATIONS

Antenna Engineering Handbook, 3rd Edition, Edited by Richard C. Johnson, McGraw Hill, 1993, pp. 5-13 to 5-16.

One-Element Loop Antenna with Finite Reflector, B. Rojarayanont and T. Sekiguchi, Electronics & Communications in Japan, vol. 59-B, No. 5, May 1976, p. 68.

Frequency- and Time-Domain Modeling of Tapered Loop Antennas in Ultra-Wideband Radio Systems, Shiou-Li Chen and Shau-Gang Mao, Graduate Institute of Computer and Communication Engineer, pp. 179-182, IEEE copyright notice 2006.

Planar Miniature Tapered-Slot-Fed Annular Slot Antennas for Ultrawide-Band Radios, Tzyh-Ghuang Ma, Student Member, and Shyh-Kang, Jeng, Senior Member, IEEE, IEEE Transactions on Antennas and Propagation, vol. 53, No. 3, Mar. 2005, pp. 1194-1202.

Self-Mutual Admittances of Two Identical Circular Loop Antennas in a Conducting Medium and in Air, K. Iizuka, Senior Member, IEEE, R. W. P. King, Fellow, IEEE, and C. W. Harrison, Jr., Senior Member, IEEE, IEEE Transactions on Antennas and Propagation, vol. AP014, No. 4, Jul. 1966, pp. 440-450.

A Broadband Eccentric Annular Slot Antenna, Young Hoon Suh and Ikmo Park, Department of Electrical Engineering, Ajou University, pp. 94-97, IEEE copyright notice 2001.

A Printed Crescent Patch Antenna for Ultrawideband Applications, Ntsanderh C. Azenui an H.Y.D. Yang, IEEE Antennas and Wireless Propragation Letters, vol. 6, 2007, pp. 113-116.

Design of Compact Components for Ultra Wideband Communication Front Ends, Marek Bialkowski, Amin Abbosh, and Hing Kan, School of Information Technology and Electrical Engineering, The University of Queensland, four pages.

(56) References Cited

OTHER PUBLICATIONS

Nonfinal Office Action dated Apr. 17, 2012 from design U.S. Appl. No. 29/376,791 which is a continuation of the instant application; 8 pages.
Tofel, Kevin C., HD Picture frame antenna, Aug. 11, 2005, http://hd.engadget.com/2005/08/11/hd-picture-frame-antenna; 1 page.
Antennas Direct, PF7 Picture Frame Antenna, Oct. 1, 2005, Antennas Direct, http://web.archive.org/web/20051001020653/http://antennasdirect.com/PF7_antenna.html, 1 page.
U.S. Office Action dated Sep. 13, 2011, issued by the U.S. Appl. No. 12/126,593, which shares a common inventor with the instant application, 13 pages.
European Search Report dated Jan. 17, 2011, issued by the European Patent Office for European Patent Application No. EP 10193159.0 which is related to the instant application through a priority claim; (5 pages).
European Supplementary Search Report and Opinion dated Oct. 7, 2010, issued by the European Patent Office for European Patent Application No. EP 08747115 (6 pages).
Clearstream™ 2V; http://www.antennasdirect.com/cmss_files/attachmentlibrary/pdf/C2-V_QS_FINAL_20120702.pdf; Jul. 2, 2012; 2 pgs.
Mao S-G et al., "Time-domain characteristics of ultra-wideband tapered loop antennas", Electronics Letters, IEE Stevenage, GB, vol. 42, No. 22, Oct. 26, 2006; 1262-1264; 2 pgs.
European Search Report dated Apr. 24, 2014 for EP application No. 14153878.5 which has the same priority claim as the instant application; 9 pgs.

* cited by examiner

HDTV ANTENNA ASSEMBLIES

CROSS REFERENCE TO RELATED APPLICATION

This application claims the benefit and priority of U.S. Provisional Application No. 62/213,437 filed Sep. 2, 2015. The entire disclosure of the above application is incorporated herein by reference.

FIELD

The present disclosure generally relates to HDTV antenna assemblies.

BACKGROUND

This section provides background information related to the present disclosure which is not necessarily prior art.

Many people enjoy watching television. The television-watching experience has been greatly improved due to high definition television (HDTV). A great number of people pay for HDTV through their existing cable or satellite TV service provider. But HDTV signals are commonly broadcast over the free public airwaves. This means that HDTV signals may be received for free with the appropriate antenna.

DRAWINGS

The drawings described herein are for illustrative purposes only of selected embodiments and not all possible implementations, and are not intended to limit the scope of the present disclosure.

Figure 5:
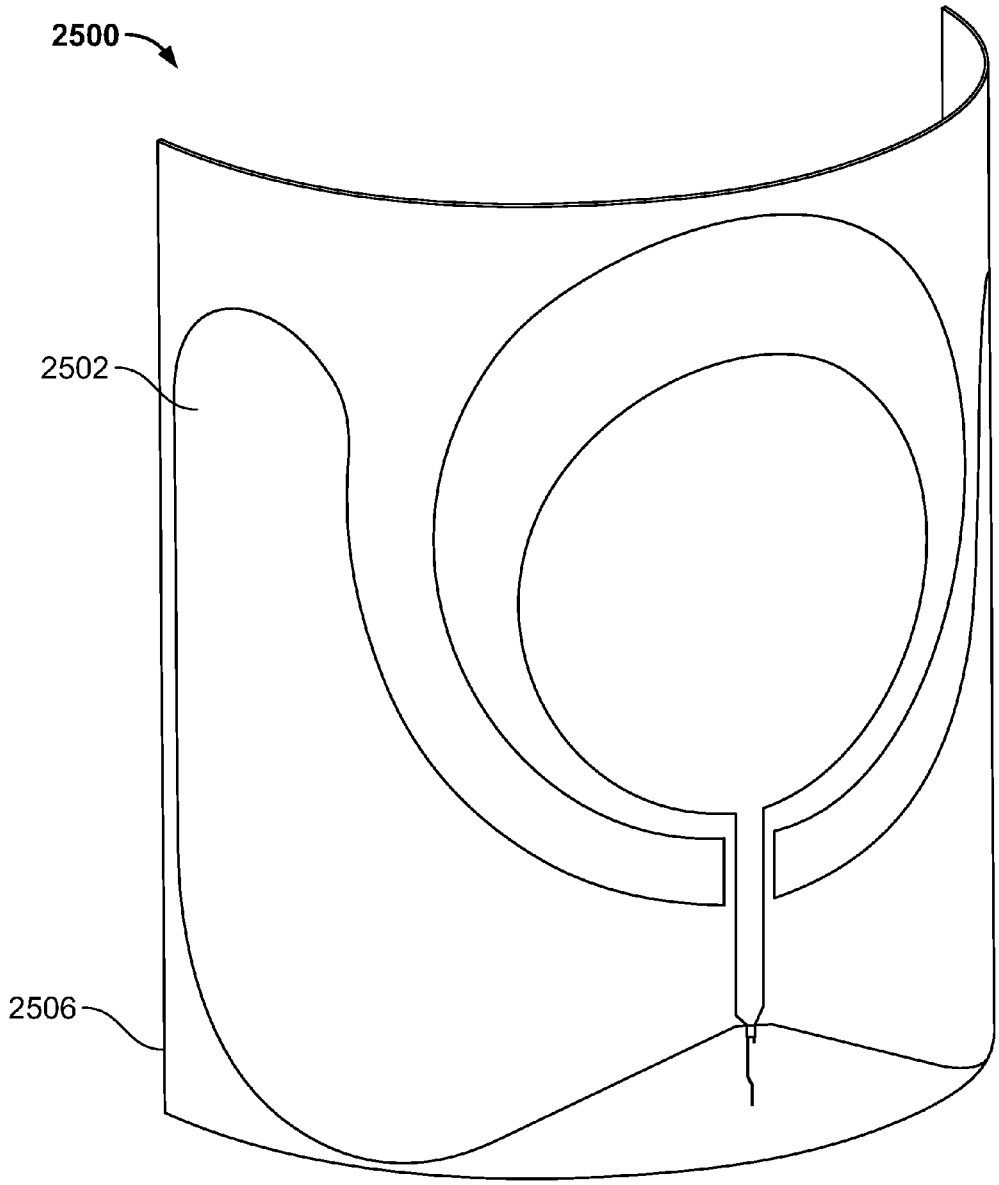
FIG. 5 illustrates an HDTV antenna assembly including antenna elements on a substrate having a radius of curvature of 150 mm according to an exemplary embodiment.
Figure 12:
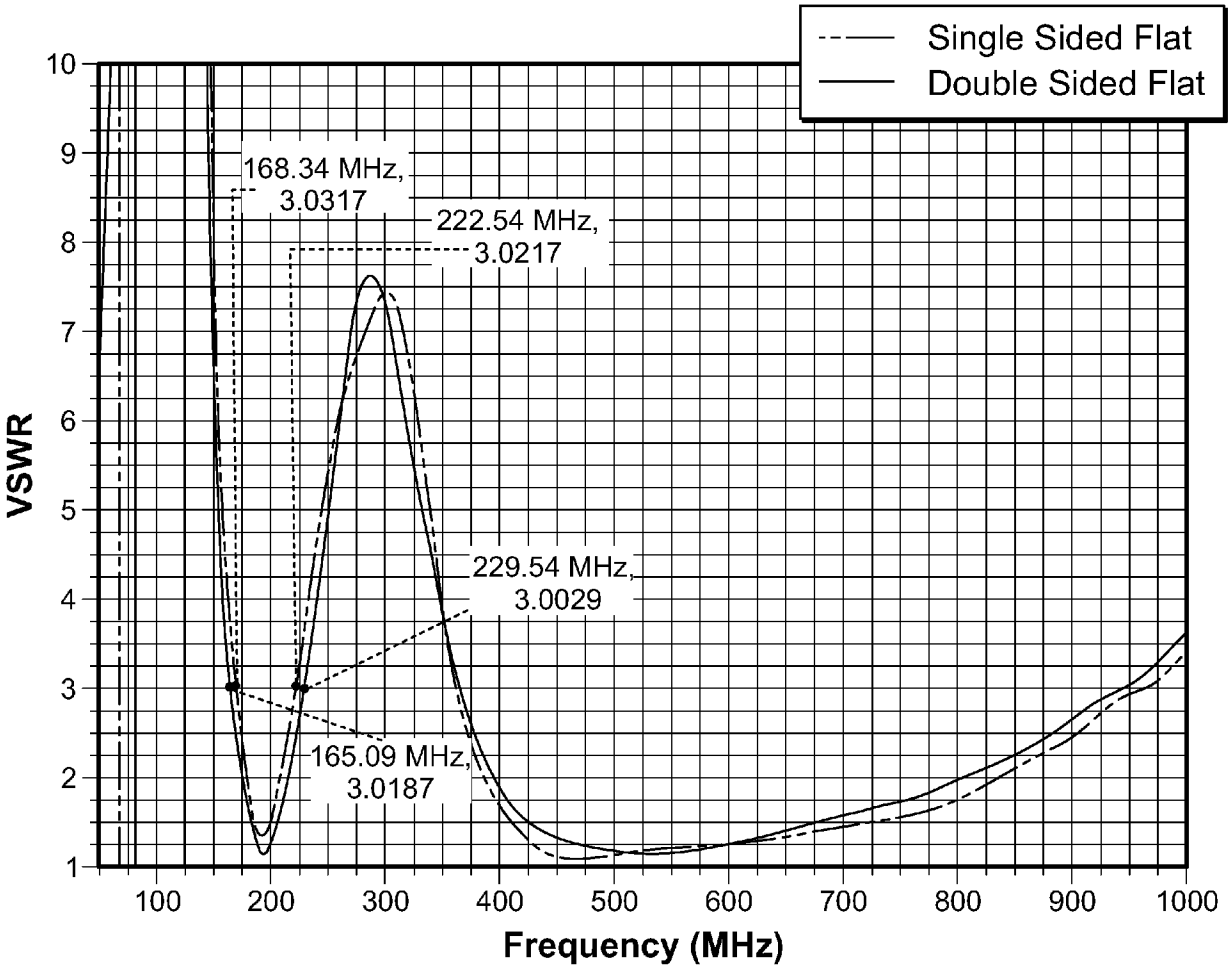
Figure 13:
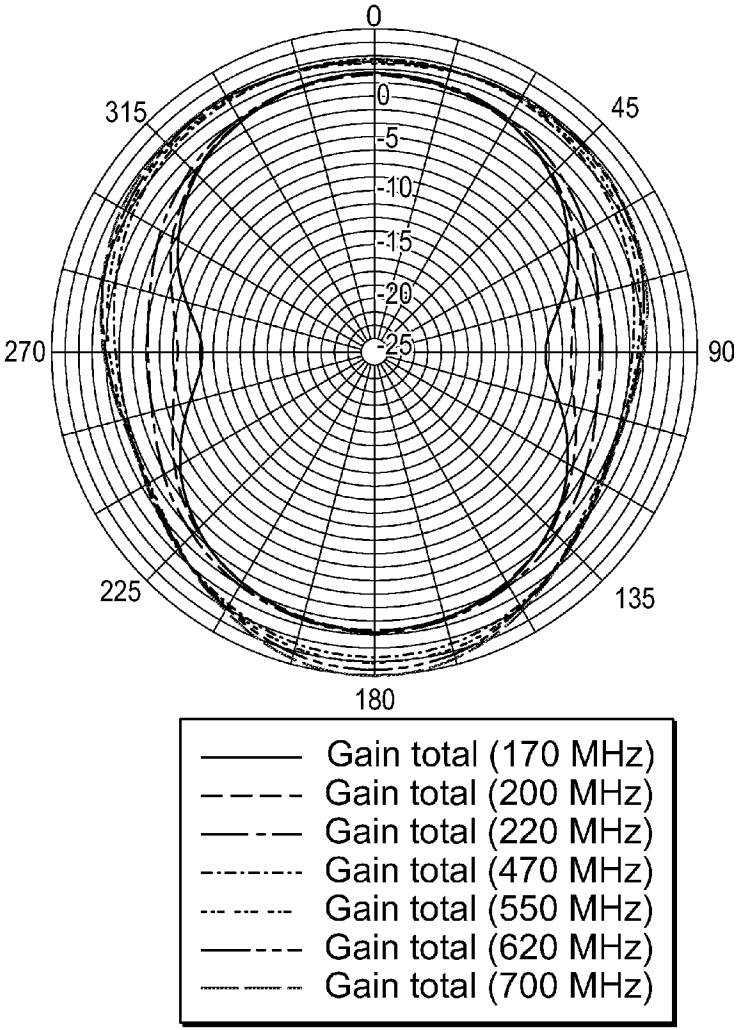

FIG. 12 is an exemplary line graph showing computer-simulated results of VSWR versus frequency (in megahertz) for a single sided antenna assembly (with the elements shown in FIG. 3 along only one side of a planar or flat substrate) and for a double sided antenna assembly (with the antenna elements shown in FIG. 3 along both sides of a planar or flat substrate); and FIG. 13 is an exemplary line graph showing computer-simulated results of gain versus Theta at frequencies of 170 MHz, 200 MHz, 220 MHz, 470 MHz, 550 MHz, 620 MHz, and 700 MHz for the antenna assembly shown in FIG. 5 with a radius of curvature of 150 mm.

Corresponding reference numerals indicate corresponding parts throughout the drawings.

DETAILED DESCRIPTION

Example embodiments will now be described more fully with reference to the accompanying drawings.

The United States frequency allocations for HDTV broadcasts currently include the low VHF band from 54 MHz to 88 MHz, the high VHF band from 174 MHz to 216 MHz, and the UHF band from 470 MHz to 698 MHz. The vast majority of stations are currently broadcasting in the high VHF and UHF bands.

As a general rule, antenna size is inversely proportional to the frequency. Therefore, antennas intended for low VHF band reception must be considerably larger than those intended for use in the high VHF and UHF bands. For the most part, consumers generally desire to have smaller antennas than larger antennas whenever possible. The smaller antennas are easier to install and do not detract from the aesthetics of a home or neighborhood. Smaller antennas also enable consumers to receive HDTV signals in mobile environments, such as an RV or camper, etc. Retailers also prefer smaller antennas due to the lower shipping fees and the fact that they take up less room on the retail shelf thus increasing revenues.

Given that the vast majority of HDTV broadcasts are currently limited to the high VHF and UHF bands, and that most consumers and retailers desire the smallest antenna possible, it makes sense to offer a compact antenna that covers only the high VHF and UHF bands. After recognizing the above, the inventors hereof developed and discloses herein exemplary embodiments of antenna assemblies that meet this need for a compact dual band high VHF/UHF antenna for HDTV reception. Exemplary embodiments of antenna assemblies disclosed herein do not require the use of a diplexer to combine signals from separate high VHF and UHF elements. In such embodiments, the antenna assembly therefore retains higher signal efficiency at lower cost than antenna assemblies comprised of separate elements.

Figure 1:
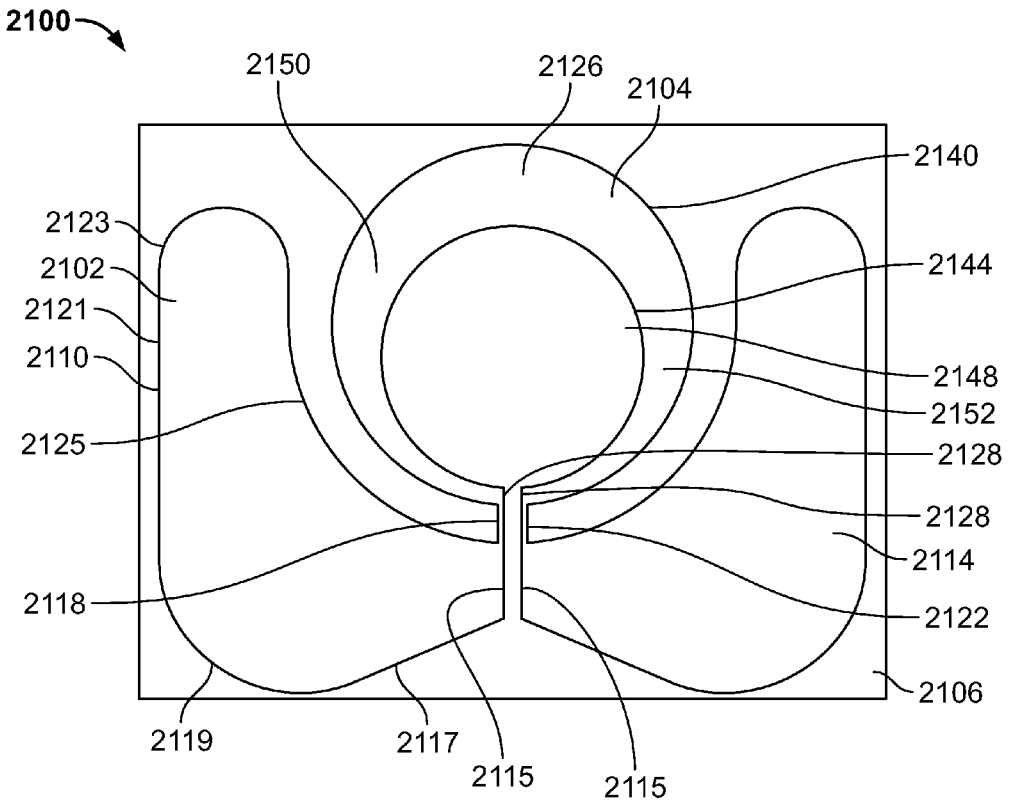
FIG. 1 illustrates an HDTV antenna assembly including antenna elements on a substrate according to an exemplary embodiment.

With reference now to the figures, FIG. 1 illustrates an exemplary embodiment of an HDTV antenna assembly 2100 embodying one or more aspects of the present disclosure. As shown, the antenna assembly 2100 includes a plurality of elements 2102 on a substrate 2106. The plurality of elements 2102 may be configured to cooperatively define a generally menorah shape (e.g., an upper portion of a menorah without the base, etc.). The antenna assembly 2100 is operable for receiving VHF and UHF high definition television signals.

The plurality of elements 2102 include a first antenna element 2104 having a generally annular shape with an opening 2148 and spaced-apart first and second portions 2128. In this example embodiment, the antenna element 2104 comprises a tapered loop antenna element having a middle portion 2126 and first and second curved portions 2150, 2152. The first and second curved portions 2150, 2152 extend from the respective first and second end portions 2128 to the middle portion 2126 such that the antenna element's annular shape and opening 2148 are generally circular. The first and second curved portions 2150, 2152 may gradually increase in width from the respective first and second end portions 2128 to the middle or top portion 2126 such that the middle portion 2126 is wider than the first and second end portions 2128 and such that an outer diameter of the antenna element 2104 is offset from a diameter of the generally circular opening 2148. The first and second curved portions 2150, 2152 may be generally symmetric such that the first curved portion 2150 is a mirror-image of the second curved portion 2152. A center of the generally circular opening 2148 may be offset from a center of the generally circular annular shape of the antenna element 2104.

In addition, the plurality of elements may further include first and second arms 2110, 2114 (broadly, antenna elements) spaced apart from the antenna element 2104. The first and second arms 2110, 2114 extend at least partially along a bottom portion and respective first and second side portions of the antenna element 2104. In this example, the first and second arms 2110, 2114 are symmetric, and the first arm 2110 is a mirror-image of the second arm 2114.

Also in this example, each of the first and second arms 2110, 2114 includes an end portion 2115 and a downwardly slanted portion 2117 extending from the end portion 2115 of the respective first and second arms 2110, 2114. A first curved portion 2119 (e.g., a partial circular or elbow portion, etc.) is between and connects the downwardly slanted portion 2117 and an upwardly extending portion 2121. A curved free end portion 2123 (e.g., a semicircular portion, etc.) is between and connects the upwardly extending portion 2121 and a concave portion 2125 that extends to the end portion 2115 of the respective first and second arms 2110, 2114.

The antenna assembly 2100 also includes first and second connectors, connecting portions, or members 2118, 2122. The first member 2118 may extend downwardly between and connect the first arm 2110 and the first end portion 2128 of the antenna element 2104. The second member 2122 may extend downwardly between and connect the second arm 2114 and the second end portion 2128 of the antenna element 2104. The first and second members 2118, 2122 are spaced apart, linear, and parallel with each other in this example.

A single continuous open slot is defined by and extends at least partially between the spaced-apart first and second end portions 2128 of the antenna element 2104, the spaced-apart first and second members 2118, 2122, and the spaced-apart end portions 2115 of the respective first and second arms 2110, 2114. The open slot may be operable to provide a gap feed for use with a balanced transmission line. The high definition television antenna assembly 2100 may further comprise a balun (e.g., 2212 shown in FIG. 2, etc.) coupled to the first and second arms 2110, 2114 at an end of the open slot opposite the opening 2148 of the antenna element 2104. By way of example only, the balun may comprise a 75 Ohm 1:1 balun, and the antenna assembly 2100 may further comprise a connector (e.g., a type F Female connector, etc.) and a feed (e.g., a 75 ohm balanced input feed, etc.). Also by way of example only, the antenna assembly 2100 may have a width of about 440 mm, a height of about 330 mm, and a depth of less than 15 mm depending on the connector type.

It is noted that the natural impedance of the tapered loop portion of the element alone is about 300 ohms in the UHF band. The natural coupling of the tapered loop portion of the element to the larger menorah shaped VHF element causes the impedance of the combined element to drop into the range of about 75 ohms across both the high VHF and UHF HDTV bands. This allows the element to be fed using a single 75 ohm 1:1 balun and eliminates the need for a costly and lossy diplexer circuit as well as separate baluns for each of the VHF and UHF elements.

With continued reference to FIG. 1, the substrate 2106 may support and/or be coupled to the antenna element 2104, the first and second arms 2110, 2114, and the first and second members 2118, 2122. The substrate 2106, the antenna element 2104, the first and second arms 2110, 2114, and the first and second members 2118, 2122 may be capable of being flexed, bent, or curved to have a radius of curvature of 300 millimeters or less.

A wide range of materials may be used for the antenna assembly 2100 and other antenna assemblies disclosed herein. In an exemplary embodiment, the substrate 2106 comprises FR4 composite material, silicone, or polyurethane rubber. Additionally, or alternatively, the substrate 2106 may have a dielectric constant of about 3.5 and/or a loss tangent of about 0.006. An outer surface or covering may be provided to the antenna assembly 2100, which outer covering may comprise a naturally tacky or self-adherent material. With the naturally tacky or self-adherent properties, the outer covering may allow the antenna assembly 2100 to be mounted or attached directly to a window or other support surface without any additional adhesives needed between the window and the naturally tacky or self-adherent outer covering or surface of the antenna assembly 2100. Advantageously, mounting an antenna assembly to a window may provide a higher and more consistent HDTV signal strength as compared to interior locations of a home. An antenna assembly may be mounted on various window types, such as a single or double pane window that is partially frosted and does not include a low e-coating, etc.

The plurality of elements 2102 (e.g., antenna element 2104, arms 2110, 2114, and members 2118, 2122) may comprise an electrically-conductive material (e.g., aluminum or copper foil, anodized aluminum, copper, stainless steel, other metals, other metal alloys, etc.). By way of example, the elements 2102 may be flat with a generally constant or uniform thickness and/or be stamped from metal (e.g., copper sheet metal, etc.). The elements 2102 may be etched on a PCB coated in copper or other suitable material (e.g., coated in one ounce of copper per square foot (equivalent to approximately 35 um thickness), etc.). Alternative embodiments may include a substrate and/or elements configured differently, e.g., that are curved, do not have a generally constant or uniform thickness, and/or formed from a different material and/or process besides stamped metal, etc. For example, the substrate 2106 may comprise a flexible polymer substrate, and the antenna element 2104, the first and second arms 2110, 2114, and the first and second members 2118, 2122 may comprise one or more thin flexible antenna elements made of electrically-conductive material sputtered on the flexible polymer substrate. As another example, the antenna element 2104, the first and second arms 2110, 2114, and the first and second members 2118, 2122 may comprise a single piece of electrically-conductive material (e.g., copper, etc.) having a monolithic construction. As a further example, the substrate 2106 may comprise a polyester substrate, and the antenna element 2104, the first and second arms 2110, 2114, and the first and second members 2118, 2122 may comprise electrically-conductive ink screen printed on the polyester substrate.

The back or rear surface(s) of the antenna assembly 2100 may be flat and planar. This, in turn, would allow the flat back surface to be positioned flush against a window. Accordingly, some exemplary embodiments of an antenna assembly do not include or necessarily need a support or mount having a base or stand for supporting or mounting the antenna assembly to a horizontal surface, to a vertical surface, or to a reflector and mounting post. In other exemplary embodiments, the antenna assembly 2100 may include a reflector and/or support having a base or stand. For example, the antenna assembly 2100 may include a dielectric center support.

In some exemplary embodiments, the substrate 2106, antenna element 2104, first and second arms 2110, 2114, and first and second members 2118, 2122 may have sufficient flexibility to be rolled up into a cylindrical or tubular shape and then placed into a tube, etc., to reduce shipping costs and decrease shelf space requirements, etc. In an exemplary embodiment, the antenna element 2104, first and second arms 2110, 2114, and first and second members 2118, 2122 may be adhered to a sticky silicone mat or substrate, which, in turn, could adhere to glass. In an exemplary embodiment, the substrate 2106 may comprise a flexible polymer substrate, and the antenna element 2104, the first and second arms 2110, 2114, and the first and second members 2118, 2122 may comprise one or more thin flexible antenna elements made of electrically-conductive material (e.g., metals, silver, gold, aluminum, copper, etc.) sputtered on the flexible polymer substrate. In another exemplary embodiment, the antenna element 2104, the first and second arms 2110, 2114, and the first and second members 2118, 2122 may comprise a single piece of electrically-conductive material (e.g., metals, silver, gold, aluminum, copper, etc.) having a monolithic construction. In still a further exemplary embodiment, the substrate 2106 may comprise a polyester substrate, and the antenna element 2104, the first and second arms 2110, 2114, and the first and second members 2118, 2122 may comprise electrically-conductive ink (e.g., silver, etc.) screen printed on the polyester substrate.

In some exemplary embodiments, the antenna assembly 2100 may include an amplifier such that the antenna assembly 2100 is amplified. In other exemplary embodiments, the antenna assembly 2100 may be passive and not include any amplifiers for amplification.

As shown in FIG. 1, the antenna element 2104 has a generally annular shape cooperatively defined by an outer periphery or perimeter portion 2140 and an inner periphery or perimeter portion 2144. The outer periphery or perimeter portion 2140 is generally circular. The inner periphery or perimeter portion 2144 is also generally circular, such that the antenna element 2104 has a generally circular opening or thru-hole 2148. The inner diameter is offset from the outer diameter such that the center of the circle defined generally by the inner perimeter portion 2144 (the inner diameter's midpoint) is below (e.g., about twenty millimeters, etc.) the center of the circle defined generally by the outer perimeter portion 2140 (the outer diameter's midpoint). The offsetting of the diameters thus provides a taper to the antenna element 2104 such that it has at least one portion (a top portion 2126 shown in FIG. 1) wider than another portion, e.g., the end portions 2128.

In exemplary embodiments, the opening or area 2148 is not a thru-hole as there is a portion of substrate under the opening 2148. In other exemplary embodiments, the opening 2148 is a thru-hole without any material within or under the opening 2148.

The antenna assembly 2100 may be positioned against a vertical window in an orientation such that the wider portion 2126 of the antenna element 2104 is at the top and the narrower end portions 2128 are at the bottom, to produce or receive horizontal polarization. For example, the vertical polarization can be received with 90 degree rotation about a center axis perpendicular to the plane of the loop of the antenna element 2104.

Figure 2:
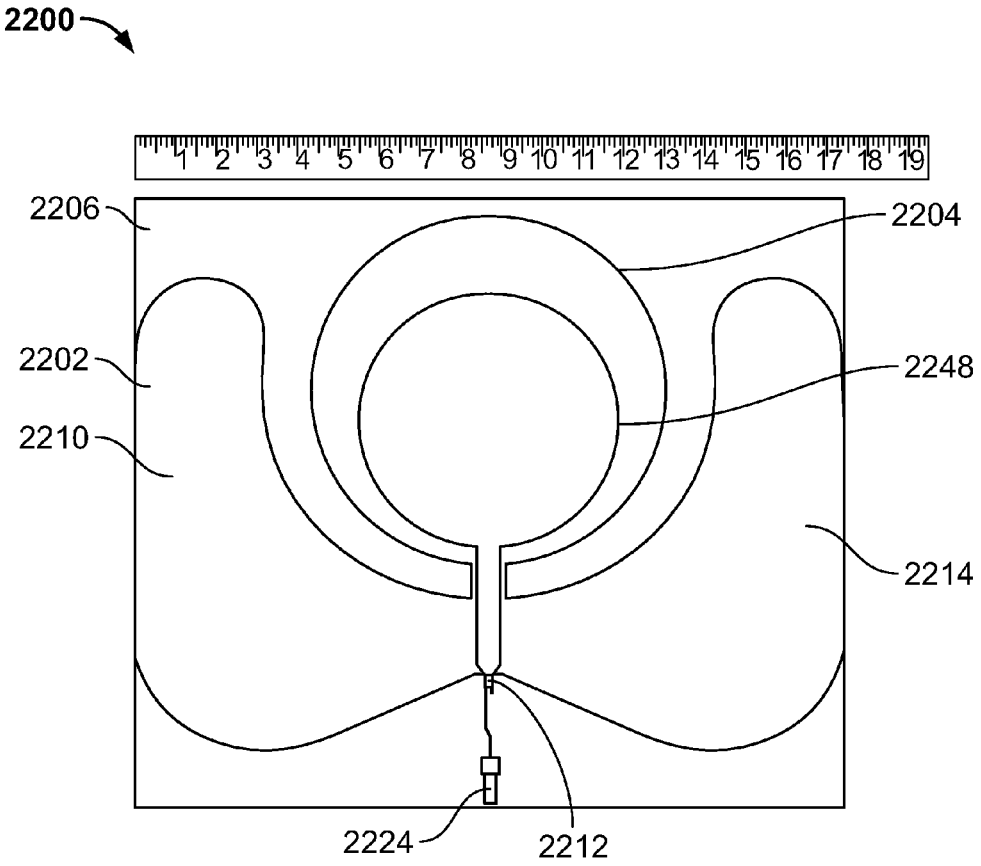
FIG. 2 illustrates a prototype HDTV antenna assembly including antenna elements on a substrate, a balun (e.g., 75 ohm 1:1 balun, etc.), a connector (e.g., a type F Female connector), and a feed (e.g., 75 ohm balanced input, etc.) according to an exemplary embodiment, where the ruler and antenna dimensions in inches gleaned therefrom are provided for purpose of illustration only.

FIG. 2 illustrates another exemplary embodiment of an antenna assembly 2200 embodying one or more aspects of the present disclosure. As shown, the antenna assembly 2200 includes a plurality of elements 2202 on a substrate 2206. The plurality of elements 2202 may be configured to cooperatively define a generally menorah shape (e.g., an upper portion of a menorah without the base, etc.). The antenna assembly 2200 is operable for receiving VHF and UHF high definition television signals.

The antenna assembly 2200 may be similar in structure and operation as the antenna assembly 2100 shown in FIG. 1 and described above. In this exemplary embodiment, a balun 2212 is shown coupled to the first and second arms 2210, 2214 at an end of the open slot opposite the opening 2248 of the antenna element 2204. By way of example only, the balun 2212 may comprise a 75 Ohm 1:1 balun. Also shown in FIG. 2 is a connector 2224 (e.g., a type F Female connector, etc.) and a feed (e.g., a 75 ohm balanced input feed, etc.). The connector 2224 may be connected to a coaxial cable (e.g., a 75-ohm RG6 coaxial cable fitted with an F-Type Male connector, etc.), which is then used for transmitting signals received by the antenna assembly 2200 to a television, etc. Alternative embodiments may include other connectors, coaxial cables, or other suitable communication links.

In exemplary embodiments in which an antenna assembly (e.g., 2100, 2200, etc.) includes a substrate (e.g., 2106, 2206, etc.) for adherence to a window or other glass surface, the substrate may comprise polyurethane rubber material that is relatively soft and sticky. In an exemplary embodiment, the substrate comprises an adhesive polyurethane soft rubber. The substrate may initially include top and bottom outermost, removable liners made of polyethylene terephthalate (PET) film. The top liner may be disposed directly on the adhesive polyurethane soft rubber in order to prevent dust and debris from adhering to the adhesive polyurethane soft rubber. The top liner may be removed when the antenna assembly is to be adhered to a window via the adhesive polyurethane soft rubber. The bottom liner may be removed to expose an acrylic adhesive for adhering the substrate to the back of the antenna assembly. The substrate may also include a carrier (e.g., PET film, etc.) on the bottom of the adhesive polyurethane soft rubber. The acrylic adhesive may be coated on the opposing surfaces of the bottom liner and carrier, respectively. The substrate, in this example, may be transparent in color, have a total thickness of about 3 millimeters, and/or have a temperature range between 20 to 80 degrees Celsius.

Figure 3:
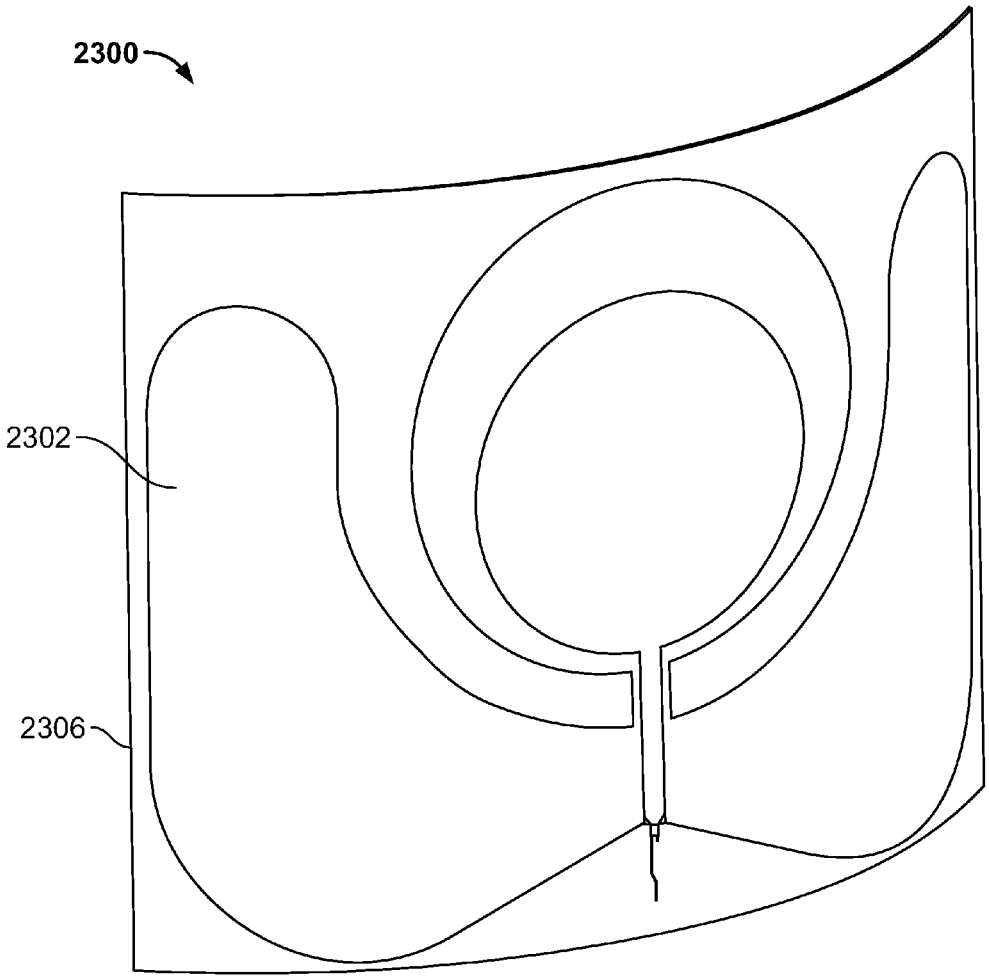
FIG. 3 illustrates an HDTV antenna assembly including antenna elements on a substrate having a radius of curvature of 300 millimeters (mm) according to an exemplary embodiment.
Figure 4:
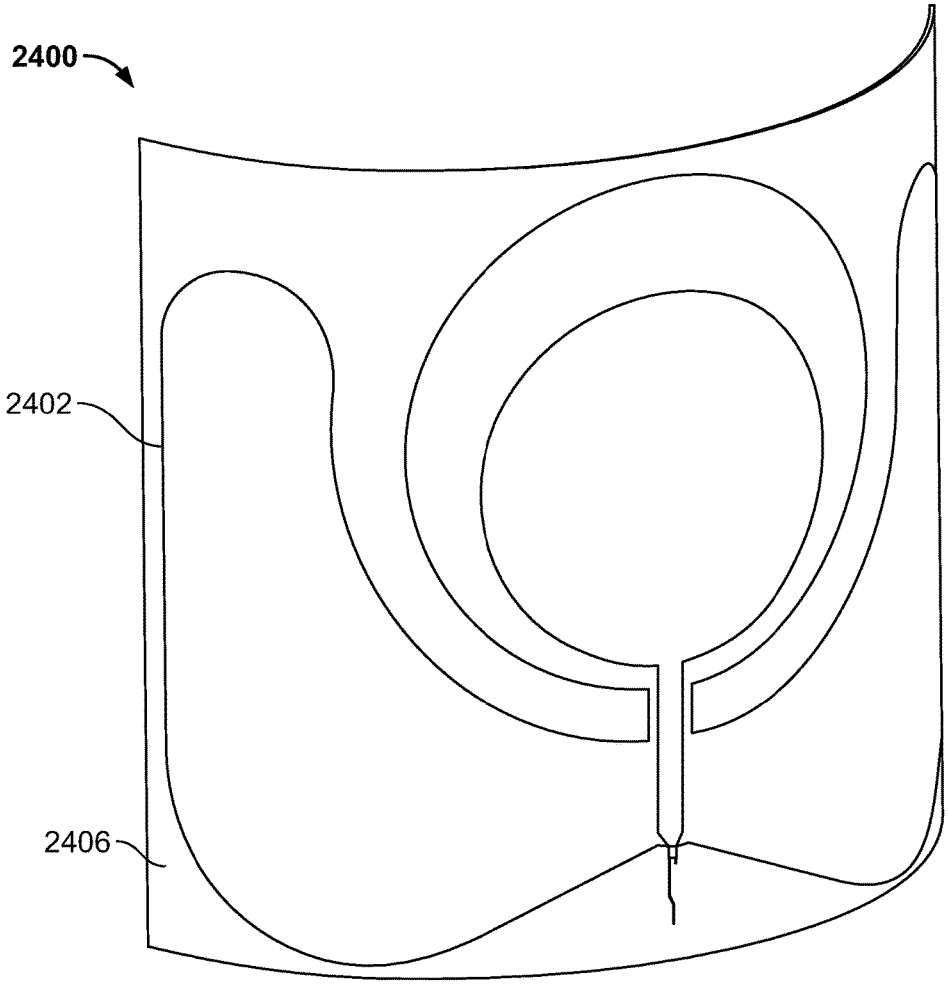
FIG. 4 illustrates an HDTV antenna assembly including antenna elements on a substrate having a radius of curvature of 200 mm according to an exemplary embodiment.
Figure 6:
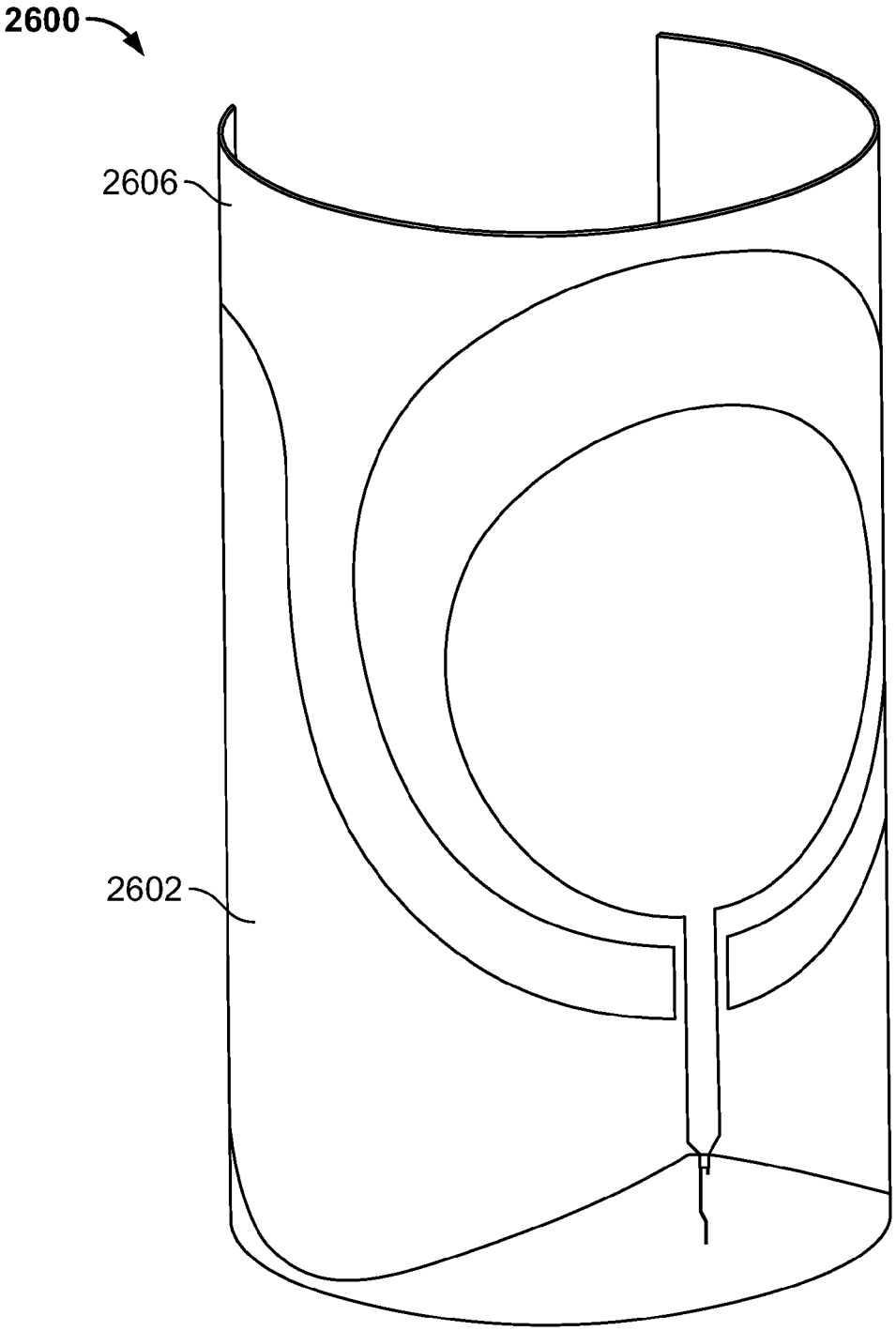
FIG. 6 illustrates an HDTV antenna assembly including antenna elements on a substrate having a radius of curvature of 100 mm according to an exemplary embodiment.
Figure 7:
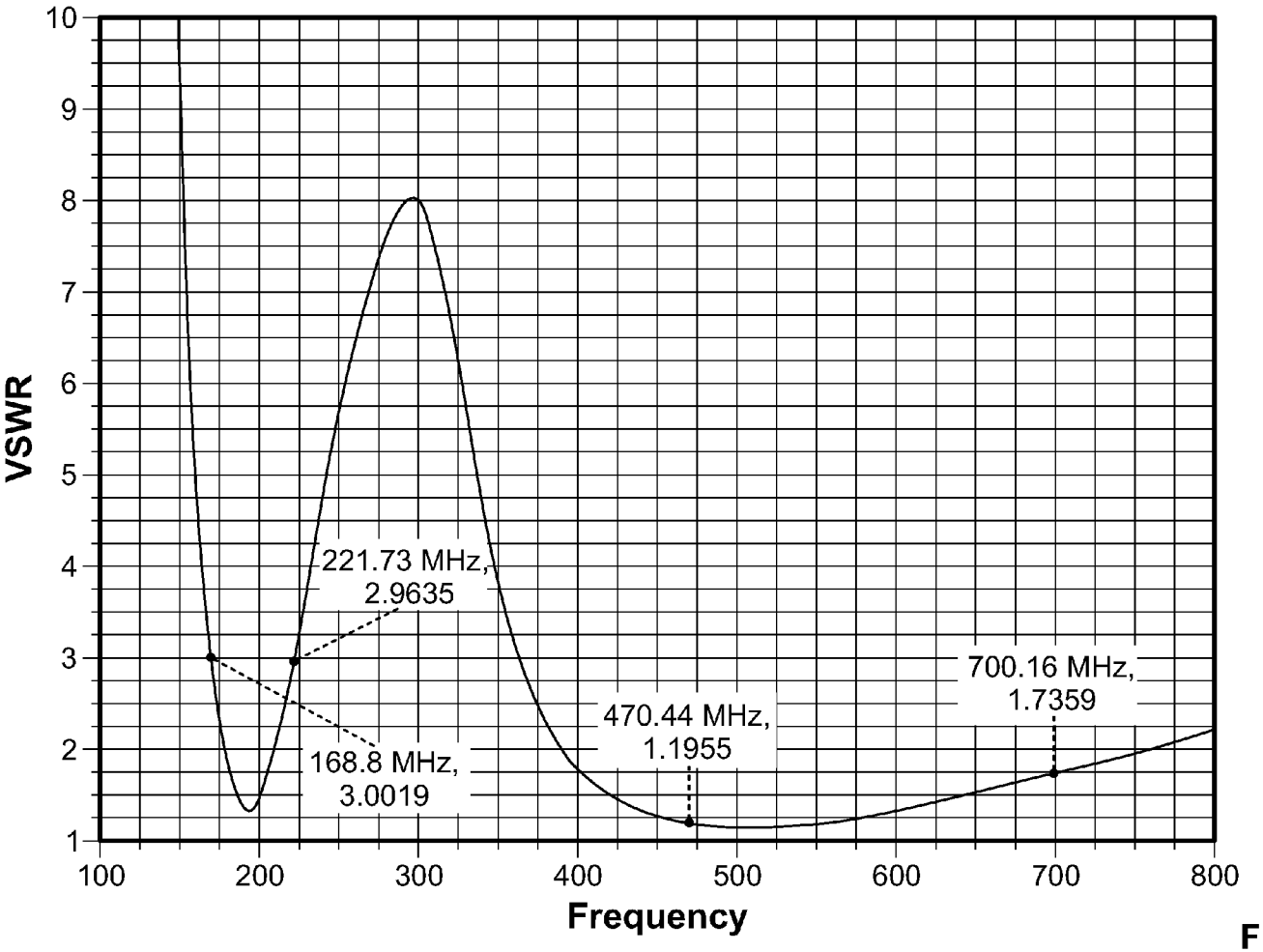
FIG. 7 is an exemplary line graph showing computer-simulated results of VSWR (voltage standing wave ratio) versus frequency (in megahertz) for the HDTV antenna assembly shown in FIG. 2.
Figure 8:
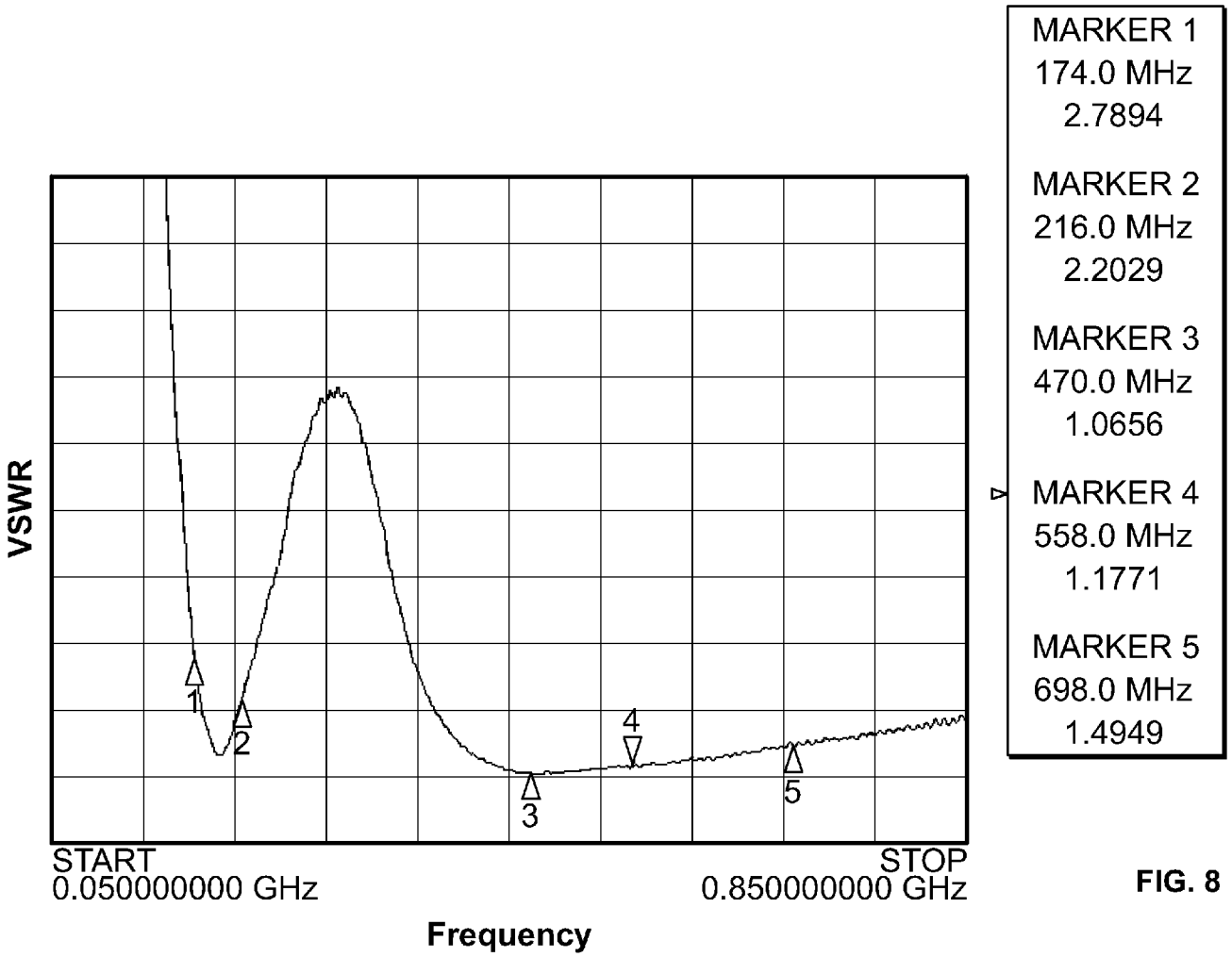
FIG. 8 is an exemplary line graph showing VSWR versus frequency measured for the prototype antenna assembly shown in FIG. 2 where the antenna elements were etched on a PCB coated in one ounce of copper per square foot (equivalent to approximately 35 um thickness)
Figure 9:
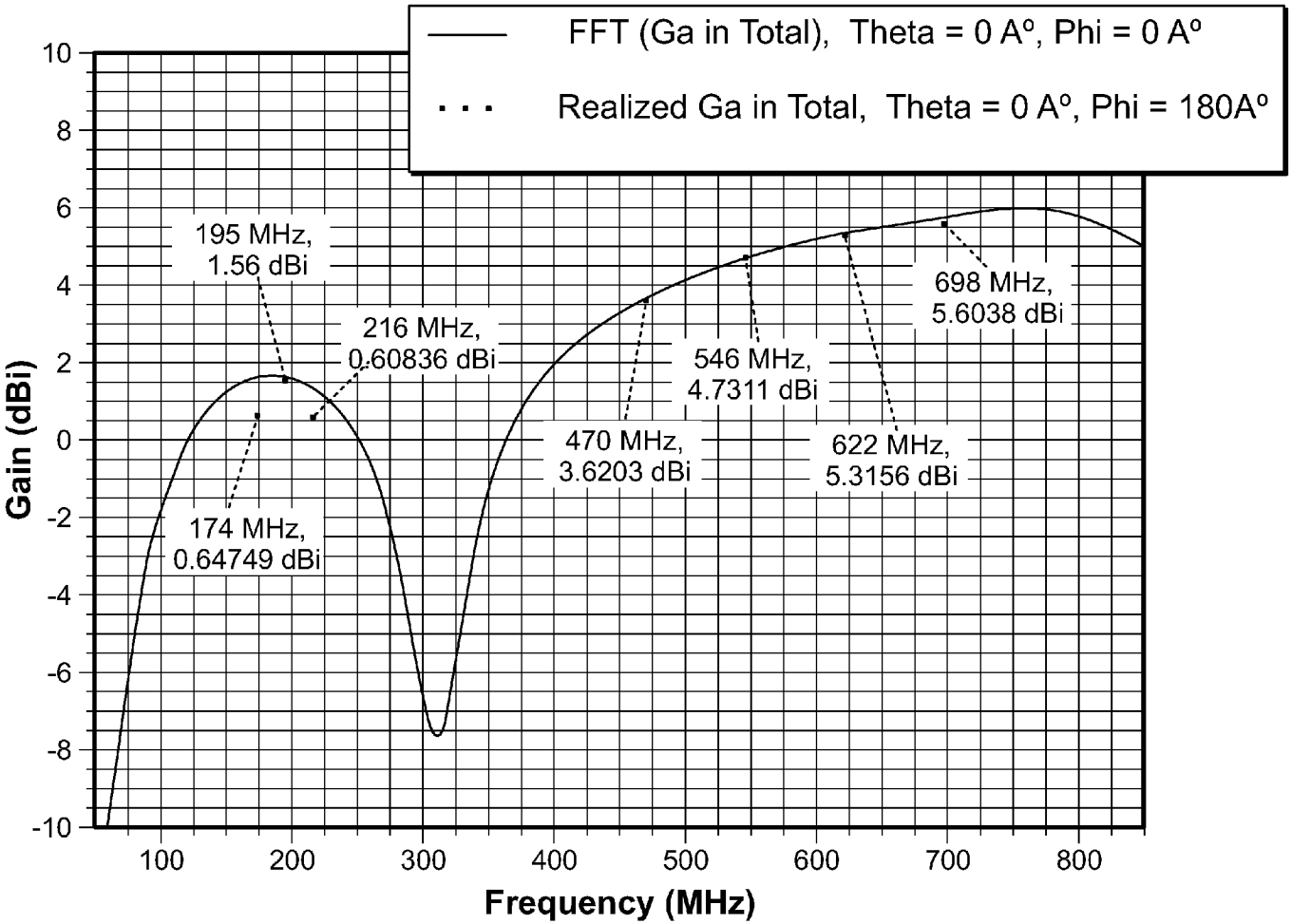
FIG. 9 is an exemplary line graph showing computer-simulated results of gain (in dBi) versus frequency (in megahertz) for the antenna assembly shown in FIG. 2.
Figure 10:
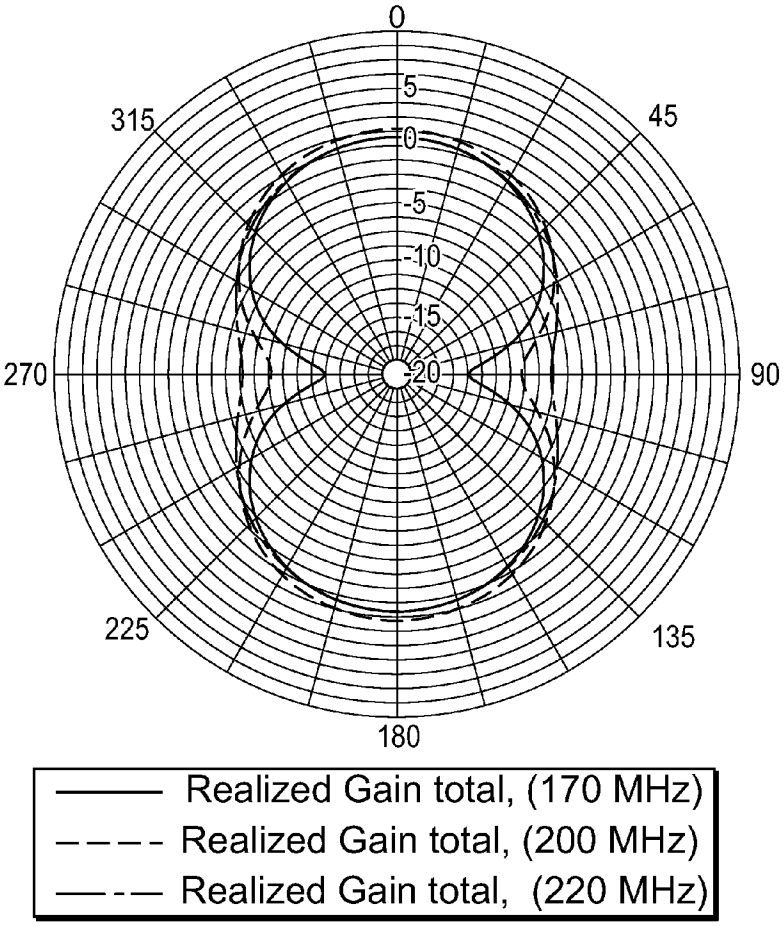
FIG. 10 is an exemplary graph showing computer-simulated results of VHF horizontal plane realized gain versus Theta at frequencies of 170 MHz, 200 MHz, and 220 MHz for the antenna assembly shown in FIG. 2.
Figure 11:
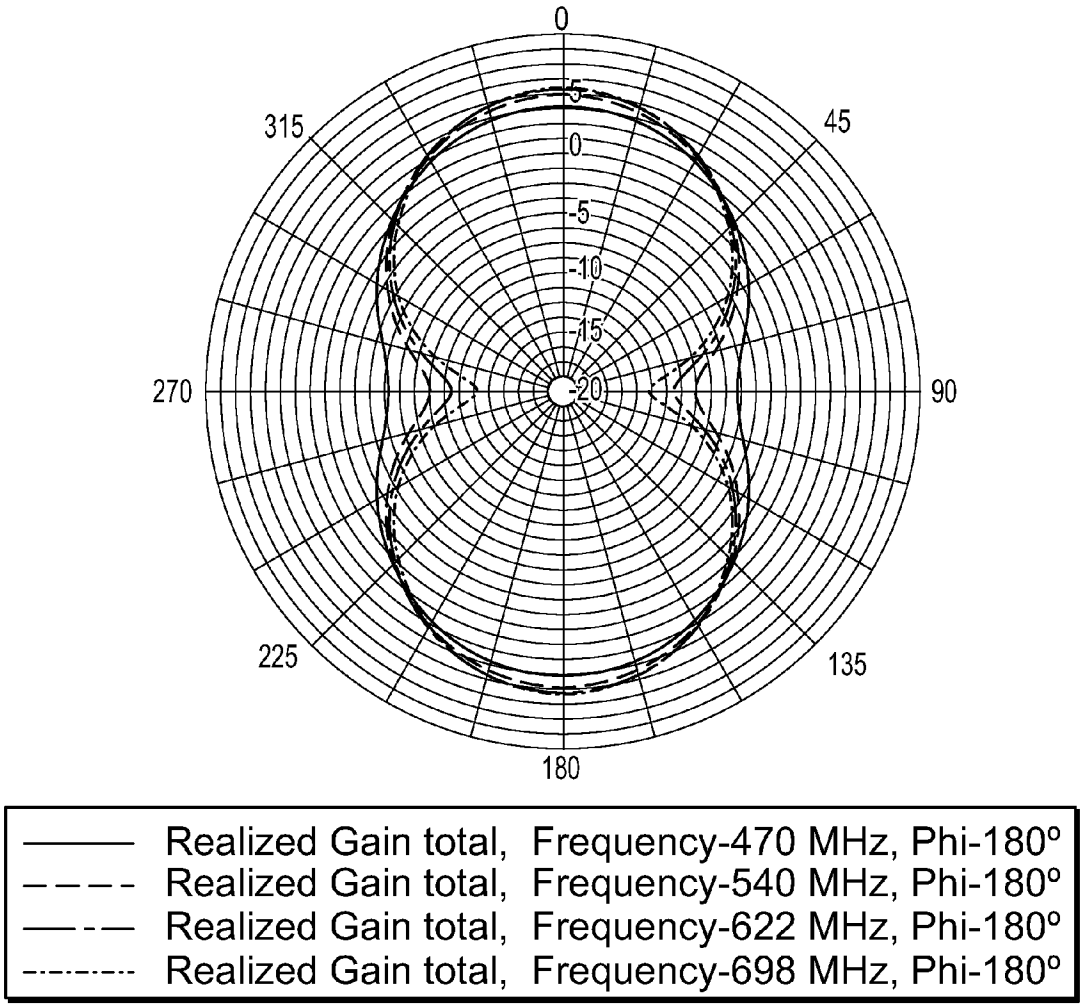
FIG. 11 is an exemplary graph showing computer-simulated results of UHF horizontal plane realized gain versus Theta at frequencies of 470 MHz, 546 MHz, 622 MHz, and 698 MHz with Phi=180° for the antenna assembly shown in FIG. 2.

In exemplary embodiments, the substrate and antenna elements thereon (e.g., tapered loop antenna element, first and second arms, and first and second connectors or members) may be sufficiently flexibility to be flexed, bent, or curved to a radius of curvature of 300 millimeters (mm) or less. For example, FIG. 3 illustrates an exemplary embodiment of an HDTV antenna assembly 2300 including antenna elements 2302 on a substrate 2306, where the antenna elements 2302 and substrate 2306 are curved to have a radius of curvature of 300 mm. FIG. 4 illustrates an exemplary embodiment of an HDTV antenna assembly 2400 including antenna elements 2402 on a substrate 2406, where the antenna elements 2402 and substrate 2406 are curved to have a radius of curvature of 200 mm. FIG. 5 illustrates an exemplary embodiment of an HDTV antenna assembly 2500 including antenna elements 2502 on a substrate 2506, where the antenna elements 2502 and substrate 2506 are curved to have a radius of curvature of 150 mm. FIG. 6 illustrates an exemplary embodiment of an HDTV antenna assembly 2600 including antenna elements 2602 on a substrate 2606, where the antenna elements 2602 and substrate 2606 are curved to have a radius of curvature of 100 mm.

The dimensions provided in the above paragraph (as are all dimensions set forth herein) are mere examples provided for purposes of illustration only, as any of the disclosed antenna components herein may be configured with different dimensions depending, for example, on the particular application and/or signals to be received or transmitted by the antenna assembly. For example, another exemplary embodiment may include an antenna element on a substrate, where the antenna element and substrate are curved to have a radius of curvature different than what is shown in FIGS. 3, 4, 5, and 6, such as a radius of curvature less than 100 mm, a radius of curvature greater than 300 mm, a radius of curvature within a range from 100 mm to 150 mm, from 100 mm to 200 mm, from 100 mm to 300 mm, from 150 to 200 mm, from 150 to 300 mm, from 200 mm to 300 mm, etc. Or, for example, another exemplary embodiment may include an antenna element on a substrate, where the antenna element and substrate are flat without any radius of curvature (e.g., HDTV antenna assembly 2100 shown in FIG. 1, HDTV antenna assembly 2200 shown in FIG. 2, etc.) or curved to have a radius of curvature.

Exemplary embodiments of the present disclosure include antenna assemblies that may be scalable to any number of (one or more) antenna elements depending, for example, on the particular end-use, signals to be received or transmitted by the antenna assembly, and/or desired operating range for the antenna assembly. By way of example only, another exemplary embodiment of an antenna assembly is double sided (e.g., for extra bandwidth, etc.) such that the antenna elements (e.g., 2102 in FIG. 1, etc.) including the antenna element (e.g., 2204, etc.), the first and second arms (e.g., 2110 and 2114, etc.), and the first and second members (e.g., 2118 and 2122, etc.), are duplicated on opposite first and second sides of the substrate (e.g., 2106, etc.). Alternative embodiments may include a high definition television antenna assembly that is single sided such that the antenna element (e.g., 2204, etc.), the first and second arms (e.g., 2110 and 2114, etc.), and the first and second members (e.g., 2118 and 2122, etc.), are along only one side of the substrate (e.g., 2106, etc.).

An antenna assembly (e.g., 2100, 2200, 2300, 2400, 2500, 2600, etc.) disclosed herein may be operable for receiving VHF and UHF high definition television signals (e.g., a VHF frequency range of about 174 MHz to about 216 MHz, a UHF frequency range from about 470 MHz to about 698 MHz, etc.). The antenna assembly may include a plurality of elements (e.g., 2102, 2202, 2302, 2402, 2502, 2602, etc.) on a substrate (e.g., 2106, 2206, 2306, 2406, 2506, 2606, etc.). The plurality of elements may include an antenna element (e.g., 2104, 2204, 2304, 2404, 2504, 2604, etc.) having a generally annular shape with an opening (e.g., 2148, 2248, 2348, 2448, 2548, 2648, etc.) and spaced-apart first and second portions (e.g., 2128, 2228, 2328, 2428, 2528, 2628, etc.) The antenna element may comprise a tapered loop antenna element having a middle portion (e.g., 2126, etc.), first and second curved portions (e.g., 2150, 2152, etc.) extending from the respective first and second end portions to the middle portion such that the antenna element's annular shape and opening are generally circular. The first and second curved portions may gradually increase in width from the respective first and second end portions to the middle portion such that the middle portion is wider than the first and second end portions and such that an outer diameter of the antenna element is offset from a diameter of the generally circular opening. The first curved portion may be a mirror image of the second curved portion. A center of the generally circular opening may be offset from a center of the generally circular annular shape of the antenna element. The tapered loop antenna element may be flat with a generally constant or uniform thickness and/or stamped from metal (e.g., copper sheet metal, etc.).

In addition, the plurality of elements may further include first and second arms (broadly, antenna elements) (e.g., 2110 and 2114, etc.) spaced apart from the antenna element (e.g., tapered loop or generally annular element, etc.). The first and second arms may extend at least partially along portions (e.g., a bottom portion and respective first and second side portions, etc.) of the antenna element. The plurality of elements may also include first and second connectors, connecting portions, or members (e.g., 2118, 2122, etc.). The first member may extend between and connect the first arm and the first end portion of the antenna element. The second member may extend between and connect the second arm and the second end portion of the antenna element. A substrate (e.g., 2106, 2206, 2306, 2406, 2506, 2606, etc.) may support and/or be coupled to the antenna element, the first and second arms, and the first and second members. The substrate, the antenna element, the first and second arms, and the first and second members may be capable of being bent, flexed, or curved to have a radius of curvature of 300 millimeters or less. The antenna element, the first and second arms, and the first and second members may cooperatively define a generally menorah shape (e.g., an upper portion of a menorah without the base, etc.).

Exemplary embodiments of an antenna assembly disclosed herein may be configured to provide one or more of the following advantages. For example, embodiments disclosed herein may provide antenna assemblies that have better VHF gain (e.g., up to 4.8 decibels (dB), etc.) and UHF gain (e.g., up to 2.5 dB, etc.) better than other existing HDTV antenna assemblies. Also, by way of example, exemplary embodiments of an antenna assembly disclosed herein may be used or included within an HDTV flat panel antenna that is operable with both VHF and UHF high definition television signals and that have better performance (e.g., the best or better VSWR curve, etc.) than other existing HDTV flat panel antennas. By way of further example, exemplary embodiments of an antenna assembly disclosed herein may be configured to be operable for receiving VHF high definition television signals from about 174 megahertz to about 216 megahertz with a voltage standing wave ratio of less than 3 (referenced to a 75 ohm line) and realized gain within a range from about 0.5 dBi to about 1.5 dBi, and for receiving UHF high definition television signals from about 470 megahertz to about 698 megahertz with a voltage standing wave ratio of less than 2 (referenced to a 75 ohm line) and realized gain within a range from about 3.8 dBi to about 5.4 dBi.

Exemplary embodiments of antenna assemblies (e.g., 2100, 2200, 2300, 2400, 2500, 2600, etc.) have been disclosed herein as being used for reception of digital television signals, such as HDTV signals. Alternative embodiments, however, may include antenna elements tuned for receiving non-television signals and/or signals having frequencies not associated with HDTV. Thus, embodiments of the present disclosure should not be limited to receiving only television signals having a frequency or within a frequency range associated with digital television or HDTV. Therefore, the scope of the present disclosure should not be limited to use with only televisions and signals associated with television.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A high definition television antenna assembly comprising:

an antenna element having a generally annular shape with an opening and first and second end portions;

first and second arms spaced apart from the antenna element and extending at least partially along portions of the antenna element;

a first member extending between the first arm and the first end portion of the antenna element; and a second member extending between the second arm and the second end portion of the antenna element; and a substrate supporting and/or coupled to the antenna element, the first and second arms, and the first and second members.

2. The high definition television antenna assembly of claim 1, wherein the antenna element, the first and second arms, and the first and second members cooperatively define a generally menorah shape configured to be operable for receiving VHF and UHF high definition television signals.

3. The high definition television antenna assembly of claim 1, wherein the antenna element, the first and second arms, and the first and second members cooperatively define a shape resembling an upper portion of a menorah not including a base of the menorah.

4. The high definition television antenna assembly of claim 1, wherein:

the first and second end portions of the antenna element are spaced apart from each other;

the first and second members are spaced apart from each other;

the first and second arms include end portions that are spaced apart from each other; and whereby a single continuous open slot is defined by and extends at least partially between the spaced-apart first and second end portions of the antenna element, the spaced-apart first and second members, and the spaced-apart end portions of the first and second arms.

5. The high definition television antenna assembly of claim 1, wherein the high definition television antenna assembly is configured to be operable for receiving VHF high definition television signals and UHF high definition television signals.

6. A flat panel antenna operable with VHF and UHF high definition television signals comprising the high definition television antenna assembly of claim 1.

7. The high definition television antenna assembly of claim 1, wherein the high definition television antenna assembly is configured to be operable for receiving VHF high definition television signals from about 174 megahertz to about 216 megahertz with a voltage standing wave ratio of less than 3 (referenced to a 75 ohm line) and realized gain within a range from about 0.5 dBi to about 1.5 dBi, and for receiving UHF high definition television signals from about 470 megahertz to about 698 megahertz with a voltage standing wave ratio of less than 2 (referenced to a 75 ohm line) and realized gain within a range from about 3.8 dBi to about 5.4 dBi.

8. The high definition television antenna assembly of claim 1, wherein:

the first and second arms are generally symmetric; and/or the first arm is a mirror-image of the second arm.

9. The high definition television antenna assembly of claim 8, wherein each of the first and second arms includes an end portion, a downwardly slanted portion extending from the end portion of the respective first and second arms, a first curved portion between the downwardly slanted portion and an upwardly extending portion, a second curved portion between the upwardly extending portion and a concave portion that extends to the end portion of the respective first and second arms.

10. The high definition television antenna assembly of claim 1, wherein:

the first member is connected to the first arm and the first end portion of the antenna element;

the first member extends downwardly from the first end portion of the antenna element to the first arm;

the second member is connected to the second arm and the second end portion of the antenna element;

the second member extends downwardly from the second end portion of the antenna element to the second arm; and the first and second members are linear and parallel with each other.

11. The high definition television antenna assembly of claim 1, wherein:

the substrate comprises FR4 composite material, silicone, or polyurethane rubber; and/or the substrate has a dielectric constant of about 3.5 and a loss tangent of about 0.006.

12. The high definition television antenna assembly of claim 1, wherein:

the high definition television antenna assembly is single sided such that the antenna element, the first and second arms, and the first and second members are along only one side of the substrate; or the high definition television antenna assembly is double sided such that the antenna element, the first and second arms, and the first and second members are duplicated on opposite first and second sides of the substrate.

13. The high definition television antenna assembly of claim 1, wherein an open slot extends from the opening of the antenna element, between the first and second end portions of the antenna element, between the first and second members, and between end portions of the first and second arms.

14. The high definition television antenna assembly of claim 13, further comprising a single balun coupled to the first and second arms at an end of the open slot opposite the opening of the antenna element, whereby the single balun is operable for feeding the antenna assembly without using a diplexer circuit.

15. The high definition television antenna assembly of claim 13, further comprising:

a 75 Ohm 1:1 balun coupled to the first and second arms at an end of the open slot opposite the opening of the antenna element;

a type F Female connector; and a 75 ohm balanced input feed.

16. The high definition television antenna assembly of claim 1, wherein the substrate, the antenna element, the first and second arms, and the first and second members are capable of having a radius of curvature of 300 millimeters or less; and/or a radius of curvature of 100, 150, 200, or 300 millimeters; and/or being rolled into an at least partial cylindrical or tubular shape.

17. The high definition television antenna assembly of claim 1, wherein the substrate comprises a naturally tacky and/or self-adherent material such that the substrate is operable for mounting the antenna assembly to a glass window without any additional adhesive needed between the glass window and the substrate.

18. The high definition television antenna assembly of claim 1, wherein:

the substrate comprises a flexible polymer substrate, and the antenna element, the first and second arms, and the first and second members comprise one or more thin flexible antenna elements made of electrically-conductive material sputtered on the flexible polymer substrate; and/or the antenna element, the first and second arms, and the first and second members comprise a single piece of electrically-conductive copper having a monolithic construction; and/or the substrate comprises a polyester substrate, and the antenna element, the first and second arms, and the first and second members comprise electrically-conductive ink screen printed on the polyester substrate.

19. The high definition television antenna assembly of claim 1, wherein the antenna element comprising a tapered loop antenna element including generally circular inner and outer perimeter portions such that the antenna element's annular shape and opening are generally circular.

20. A antenna assembly operable for receiving VHF and UHF high definition television signals, the antenna assembly comprising:

a plurality of antenna elements including:

a tapered loop antenna element having a generally annular shape with an opening and first and second end portions;

first and second arms spaced apart from the tapered loop antenna element and extending at least partially along portions of the tapered loop antenna element;

a first member extending between and connecting the first arm and the first end portion of the tapered loop antenna element; and a second member extending between and connecting the second arm and the second end portion of the tapered loop antenna element; and a substrate supporting and/or coupled to the plurality of antenna elements.

21. The antenna assembly of claim 20, wherein the plurality of antenna elements cooperatively define a generally menorah shape.

22. The antenna assembly of claim 20, wherein:

the first and second arms are generally symmetric;

the first arm is a mirror-image of the second arm;

the first and second end portions of the tapered loop antenna element are spaced apart from each other;

the first and second members are spaced apart from each other;

the first and second arms include end portions that are spaced apart from each other; and a single continuous open slot is defined by and extends at least partially between the spaced-apart first and second end portions of the tapered loop antenna element, the spaced-apart first and second members, and the spaced-apart end portions of the first and second arms.

23. A high definition television antenna assembly comprising:

an antenna element having a generally annular shape with an opening and first and second end portions;

first and second arms spaced apart from the antenna element and extending at least partially along portions of the antenna element;

a substrate supporting and/or coupled to the antenna element and the first and second arms;

wherein:

the substrate, the antenna element and the first and second arms are capable of having a radius of curvature of 300 millimeters or less;

the antenna element and the first and second arms cooperatively define a generally menorah shape; and the high definition television antenna assembly is configured to be operable for receiving VHF and UHF high definition television signals.

24. The high definition television antenna assembly of claim 23, further comprising:

a first member extending between and connecting the first arm and the first end portion of the antenna element;

a second member extending between and connecting the second arm and the second end portion of the antenna element; and a single balun for feeding the antenna assembly without using a diplexer circuit and without using separate baluns for the antenna element and the first and second arms.

* * * * *